US006966469B2

(12) United States Patent
Wassum

(10) Patent No.: US 6,966,469 B2
(45) Date of Patent: Nov. 22, 2005

(54) SPOUT CLOSURE FOR LIQUID PACKAGINGS

(75) Inventor: Markus Wassum, Gottmadingen (DE)

(73) Assignee: SIG Technology Ltd., Neuhausen am Rheinfall (CH)

( * ) Notice: Subject to any disclaimer, the term of this patent is extended or adjusted under 35 U.S.C. 154(b) by 0 days.

(21) Appl. No.: 10/514,706

(22) PCT Filed: May 15, 2003

(86) PCT No.: PCT/CH03/00313

§ 371 (c)(1),
(2), (4) Date: Dec. 22, 2004

(87) PCT Pub. No.: WO03/097474

PCT Pub. Date: Nov. 27, 2003

(65) Prior Publication Data

US 2005/0173470 A1 Aug. 11, 2005

(51) Int. Cl.[7] ..... B65D 47/06
(52) U.S. Cl. ..... 222/529; 222/143; 222/551; 229/915
(58) Field of Search ..... 222/143, 529, 222/551; 229/915

(56) References Cited

U.S. PATENT DOCUMENTS

| | | | | |
|---|---|---|---|---|
| 3,326,421 | A * | 6/1967 | Peace | 222/529 |
| 3,401,827 | A | 9/1968 | Messina | 220/94 |
| 4,320,861 | A | 3/1982 | Rieke et al. | 222/541 |
| 4,848,601 | A * | 7/1989 | Reil | 222/528 |
| 5,004,126 | A * | 4/1991 | Klesius | 222/529 |
| 5,601,215 | A * | 2/1997 | Stolz | 222/529 |
| 5,638,976 | A | 6/1997 | Arnold | 220/298 |
| 5,941,425 | A * | 8/1999 | Stolz | 222/529 |
| 5,950,876 | A * | 9/1999 | McLelland et al. | 222/529 |
| 6,237,818 | B1 * | 5/2001 | Kline | 222/529 |
| 6,454,137 | B1 * | 9/2002 | Sturk | 222/529 |
| 6,712,246 | B2 * | 3/2004 | Nobbio | 222/529 |

FOREIGN PATENT DOCUMENTS

| | | |
|---|---|---|
| DE | 1087968 | 8/1960 |
| JP | 10-264950 | 10/1998 |
| WO | WO 97/31836 | 9/1997 |

* cited by examiner

*Primary Examiner*—Kenneth Bomberg
(74) *Attorney, Agent, or Firm*—Edwin D. Schindler

(57) ABSTRACT

The pouring closure (1) for liquid packagings (2) comprises a pouring stem (9) with a radially projecting bottom edge (12) and a threaded cover (11). Threaded cover (11) has a larger diameter than pouring stem (9), and an elastically deformable ring element (10) is disposed between pouring stem (9) and threaded cover (11). The ring surface (13) of the ring element runs obliquely to the ring plane, with the inner ring edge (14) ending in an downwardly directed projection (15) which can be clipped over pouring stem (9). The outer ring edge (16) ends in an upwardly directed projection (25), which is provided with an outer thread (26) for screwing on cover (11). The ring element (10) can be elastically deformed to spring into two stable states, namely and firstly, into a state with the ring surface (13) sloping downwards from the inner (14) to the outer (16) ring edge. In this state, the pouring closure (1) is compressed, and less than 5 mm high. In the other state with the ring surface (13) rising upwards, the pouring closure (1) is around three times higher and ensures the liquid can be reliably poured out beyond the 5 mm high rim (6) of liquid packaging (2), which is positioned approximately 11 mm distant from pouring stem (9).

9 Claims, 8 Drawing Sheets

E-E

SPOUT CLOSURE FOR LIQUID PACKAGINGS

BACKGROUND OF THE INVENTION

1. Technical Field of the Invention

Figure 1:
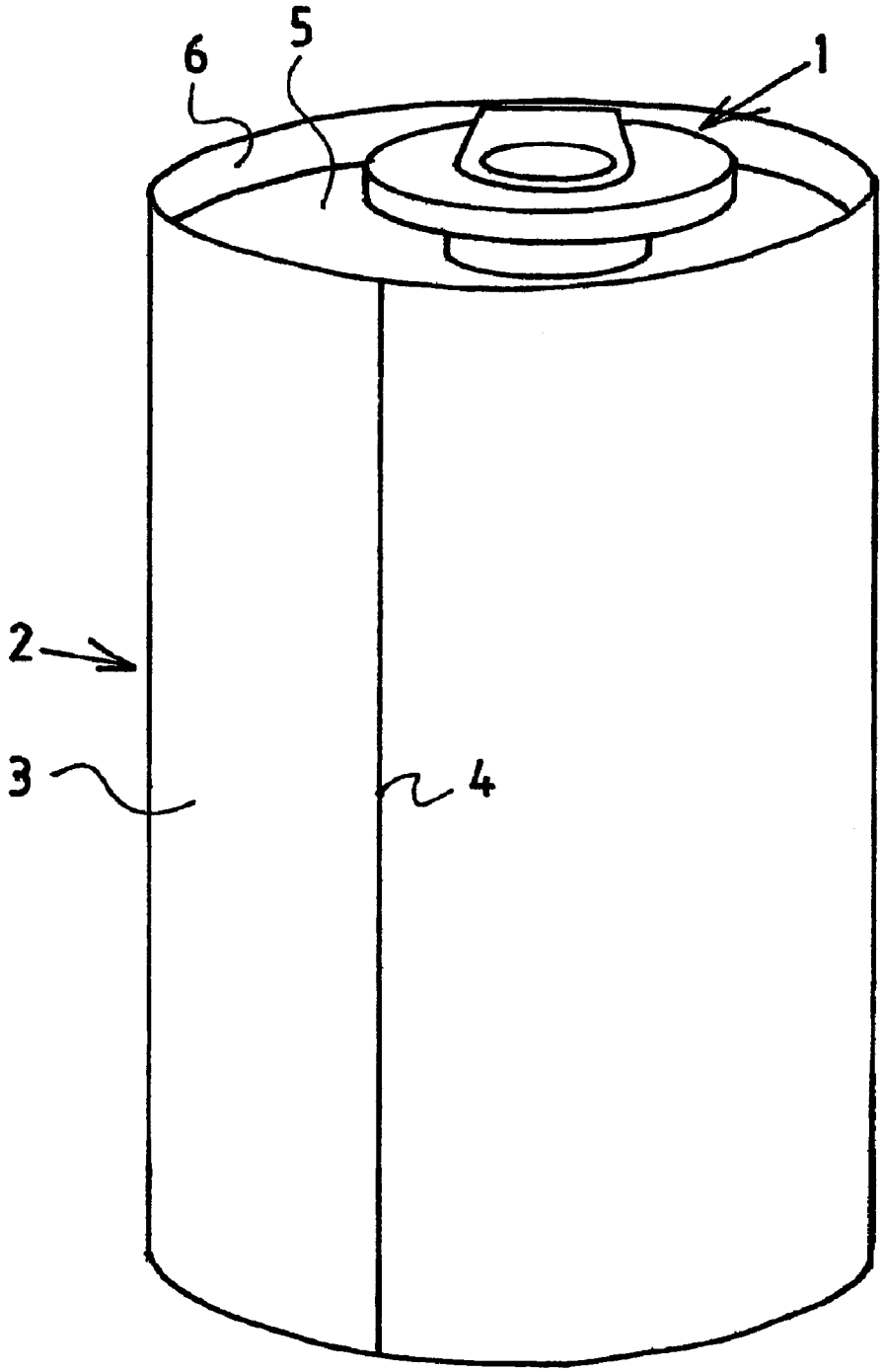

This invention relates to a pouring closure for liquid packagings of all kinds. The liquid packagings in mind are made from foil-coated paper, in which e.g. milk, fruit juices, all kinds of non-alcoholic beverages or other liquids in general are packed. The usual volumes of such liquid packagings range from 0.125 to 2 liters. Plastic pouring closures for packagings of this kind are already known. They form a pouring stem with an edge projecting radially from the bottom edge and an outer thread on the stem. A threaded cap is screwed onto the stem as a closure. This pouring stem is introduced into the top limiting surface of the packaging from below, via a hole, and the top side of the projecting edge is welded to the underside of the limiting surface by means of ultrasound, causing the plastic coating to join sealingly with the projecting edge of the stem. The packaging is then machine-sealed, filled, and the threaded cap is screwed onto the stem. One preferred packaging form has vertical sides which extend slightly beyond the top horizontal limiting surface of the packaging, thereby forming a rimmed edge or a rim of about 2 to 5 mm, which results from the technical production process, but also gives the packaging an elegant appearance whilst furthermore ensuring it can be stacked. In the case of a pouring closure for this type of packaging, it is important that the height of the pouring stem extends beyond the rim as far as necessary to achieve a reliable pouring geometry in order to ensure reliable pouring. This type of pouring geometry is achieved when, with the stem open and the packaging tilted slowly into the pouring position, the flow of poured liquid always reaches reliably beyond the rim, and no liquid ends up in the area inside the rim and hence on the top limiting surface. Furthermore, the pouring stem also has to be designed so that it does not attract the liquid during pouring due to capillary effects and surface tension, with the result that the latter runs e.g. down the outside of the stem and ends up, when the packaging is tilted back, collecting on the top limiting surface and inside the rim. Depending on the horizontal distance of the stem from the rim when the packaging is in an upright position, the stem has to extend beyond the rim to a greater or lesser degree in order to ensure a reliably functioning pouring geometry.

2. Description of the Prior Art

Conventional pouring closures of the type described above consist of only two elements, namely a stem with a radial projection at the bottom and a matching threaded cap. Their pouring geometry leaves something to be desired, and these conventional pouring closures also mean that packagings fitted with them cannot be stacked. If two packagings are stacked on top of each other, the bottom of the top packaging rests on the top of the cap of the packaging underneath, instead of only on the rim running round the top limiting surface. Because liquid packagings with conventional pouring closures cannot be stacked, cardboard boxes, crates or cages made from wood, plastic or metal are required to accommodate the liquid packagings; these can then be stacked irrespective of their contents. It would be desirable if cardboard trays with a low rim could be used; the liquid packagings would be arranged in rows on the trays so that each tray could rest directly on the liquid packagings arranged in rows on a tray underneath. Several such cardboard trays could then be stacked on top of each other, with six-unit and twelve-unit trays as already in use now being suitable, although they could not be stacked on top of the liquid packagings in another tray if said packagings are fitted with a conventional pouring closure. It would be desirable, therefore, to achieve this stackability and still be able to handle, transport and store the packagings reliably. If the bottom of each upper tray were to rest as desired on the rims of the packagings below, several trays filled with liquid packagings arranged in rows could be stacked directly on top of each other. The weight of the upper trays would be distributed over the peripheral walls of all the packagings below. Prior art pouring closures prevent such stacking because they have to project beyond the rim to ensure the pouring geometry. The general aim is to design the pouring closures to be as low as possible and to ensure that the trays can be stacked.

SUMMARY OF THE INVENTION

It is therefore the task of this invention to create a pouring closure for liquid packagings which, fitted to such a liquid packaging, ensures by virtue of its pouring geometry a reliable, clean pouring operation, whilst also ensuring the stackability of the liquid packagings to which it is fitted.

This task is solved by a pouring closure for liquid packagings comprising a pouring stem with a radially projecting bottom edge and a threaded cover, characterised in that the pouring closure can be elastically deformed into two stable states, so that it can be moved in the axial direction into a stable compressed position and a stable extended position.

BRIEF DESCRIPTION OF THE DRAWING FIGURES

The drawings show an advantageous embodiment of this pouring closure for liquid receptacles in various views; it will now be described, and its mode of functioning explained, with reference to these drawings.

Figure 2:
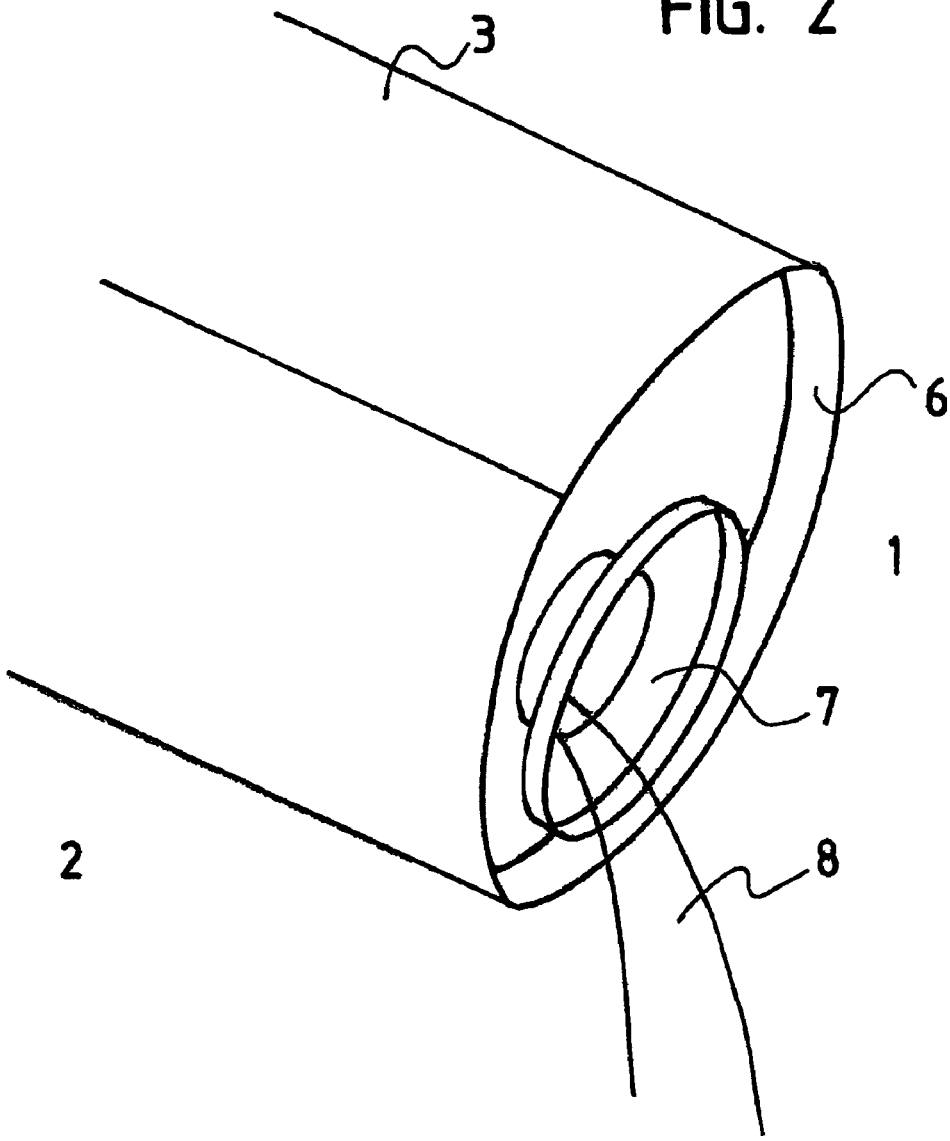
Figure 3:
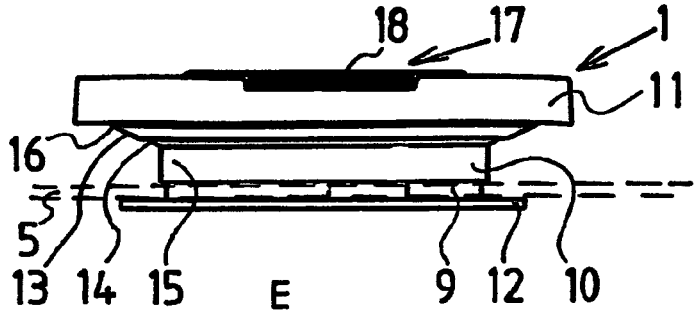
Figure 4:
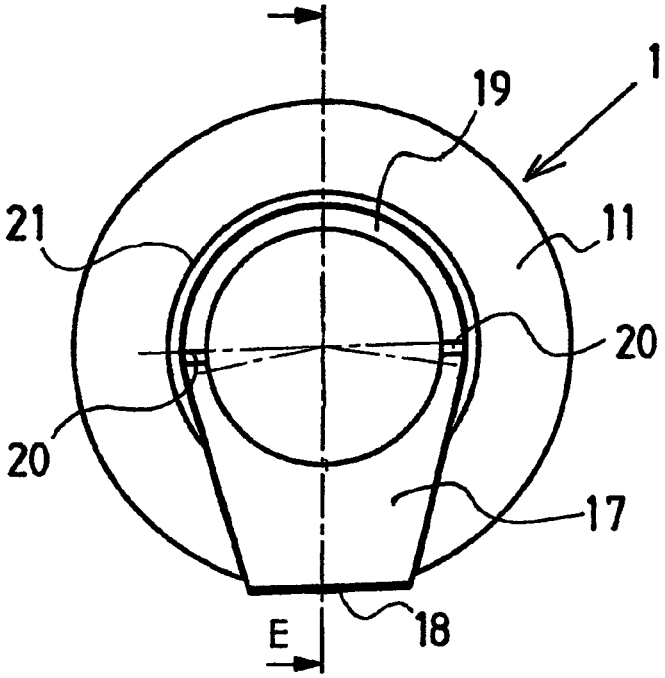
Figure 5:
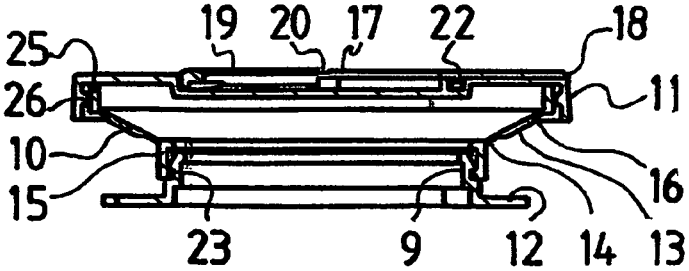
Figure 6:
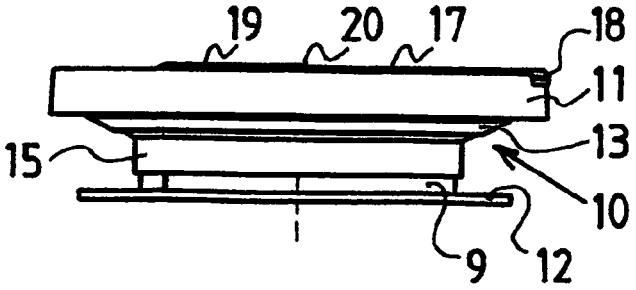
Figure 7:
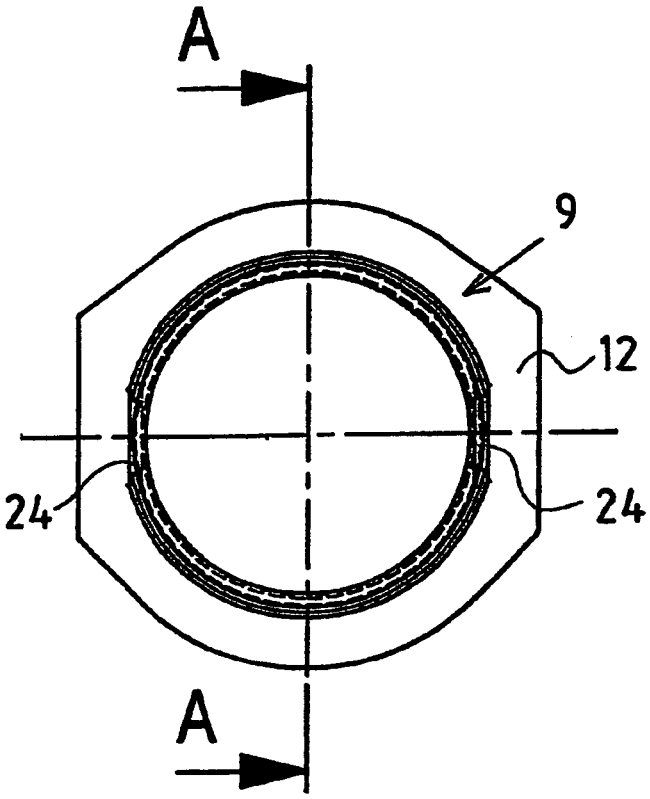
Figure 8:
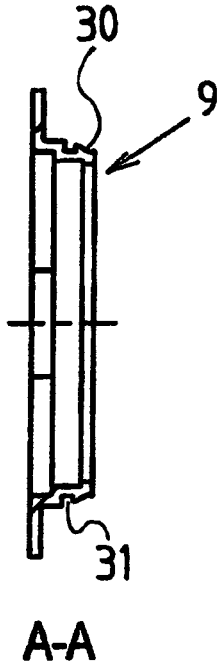
Figure 9:
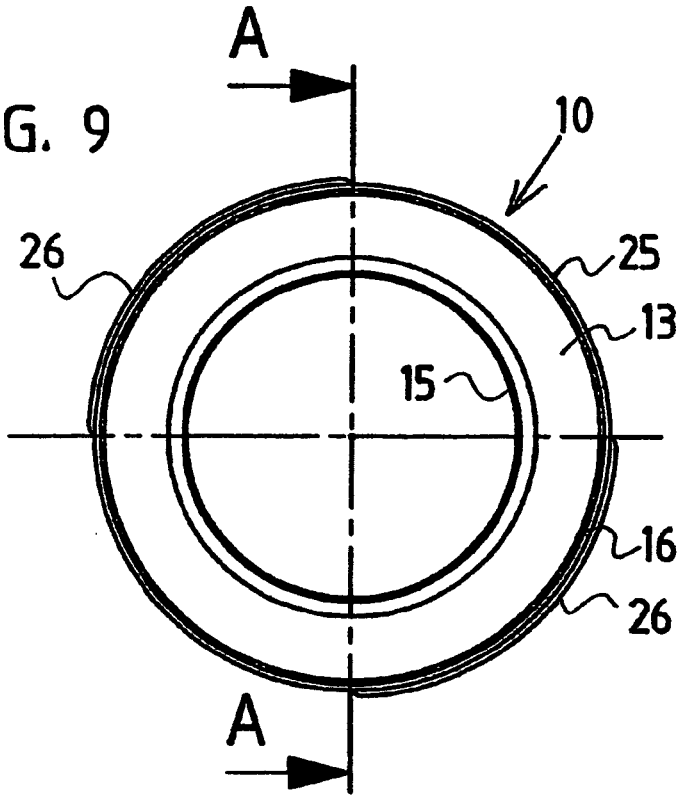
Figure 10:
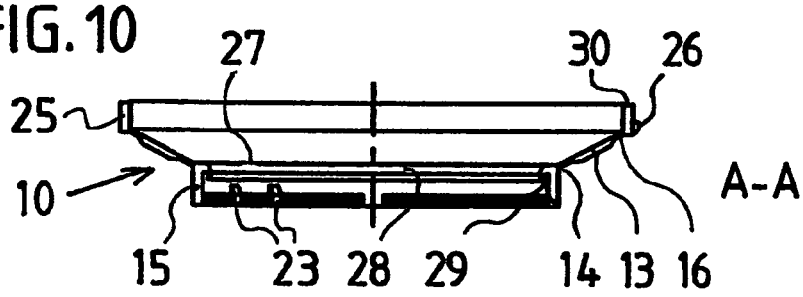
Figure 11:
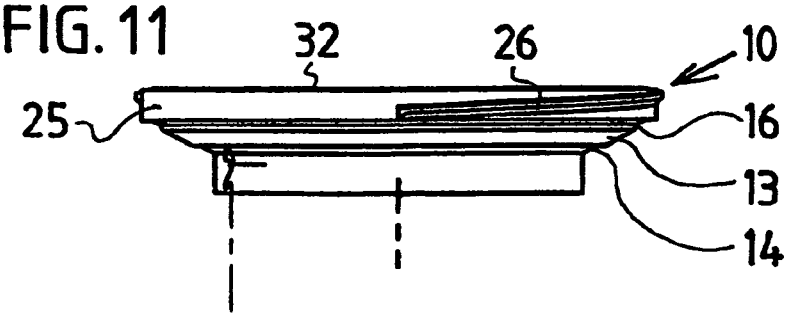
Figure 12:
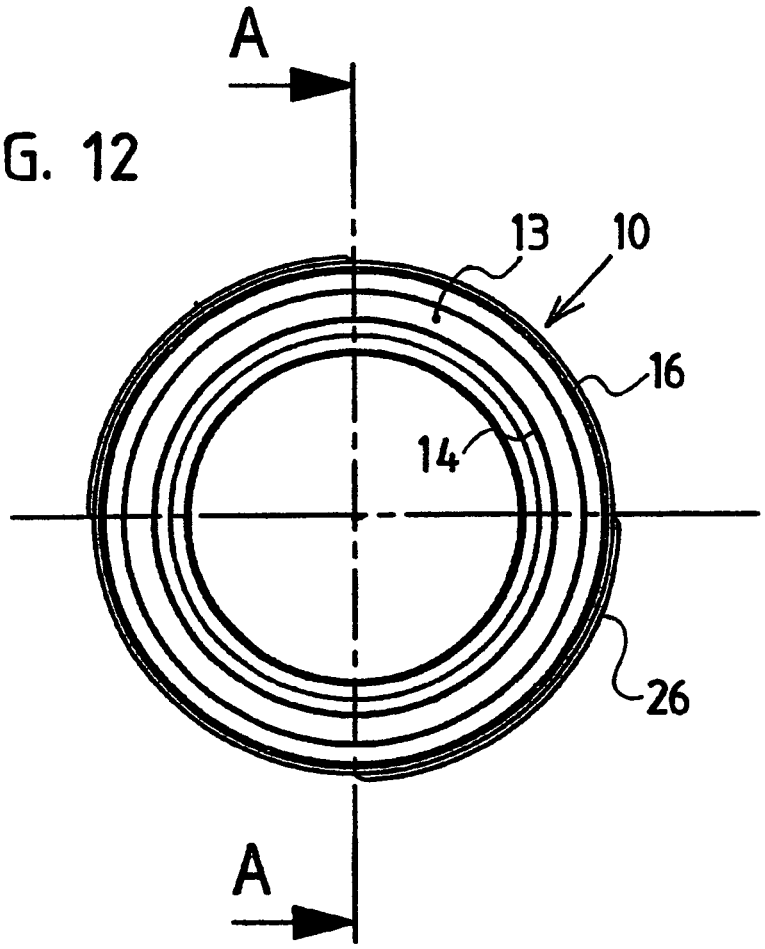
Figure 13:
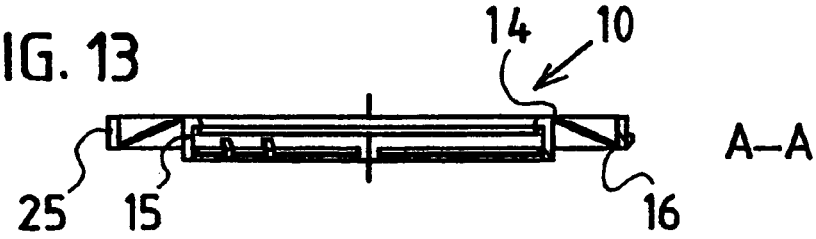
Figure 14:
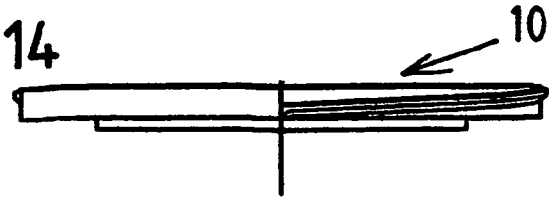
Figure 15:
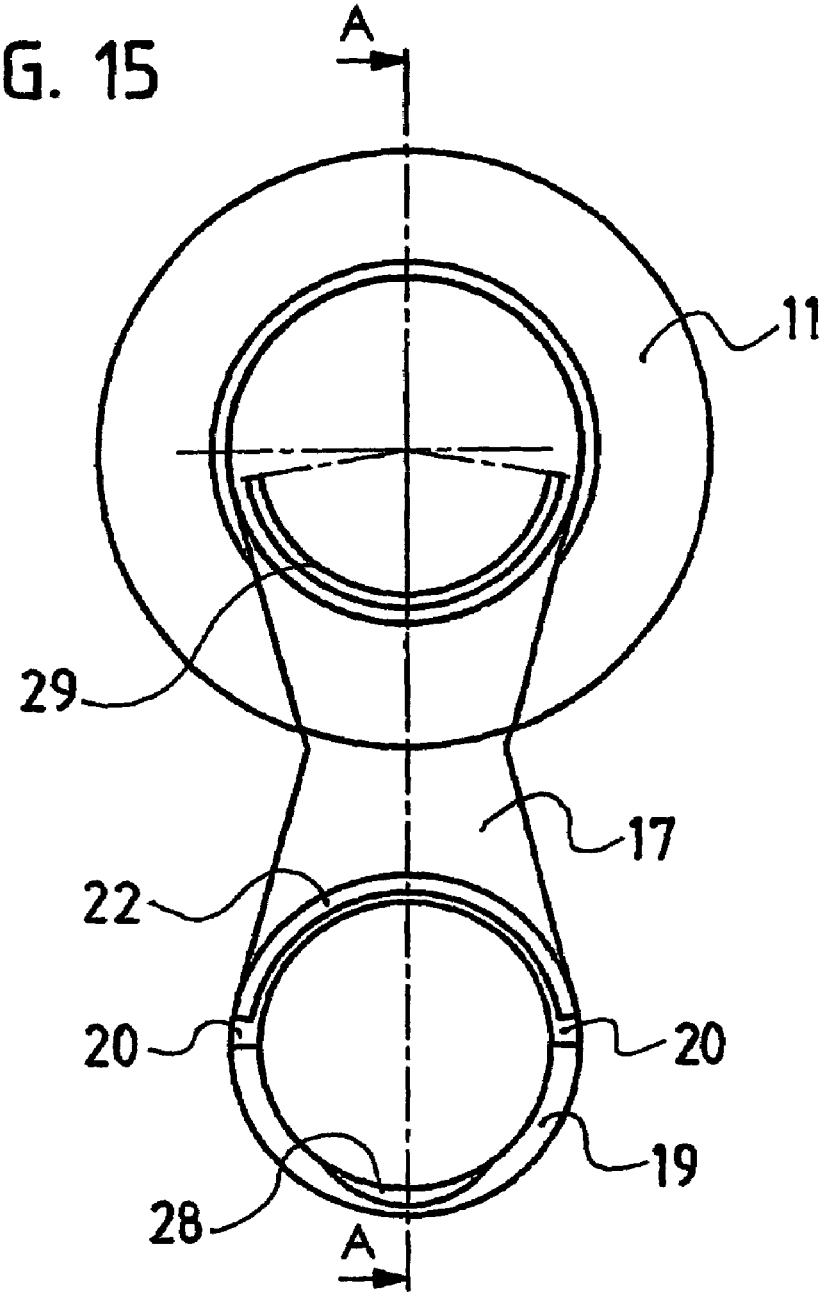
Figure 16:
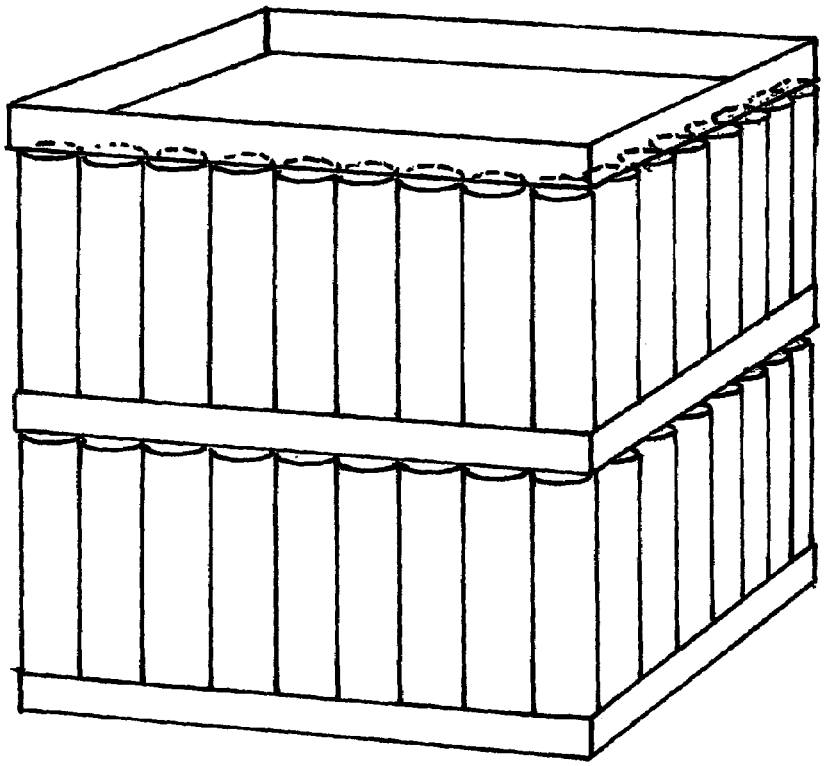

The drawings show:

FIG. 1: The pouring closure inserted in the top of a liquid packaging;

FIG. 2: The opened pouring closure with the liquid packaging in pouring position;

FIG. 3: A vertical section of the pouring closure, seen from the rear, looking at the folding edge of the foldable tongue on the cover;

FIG. 4: The pouring closure seen from above in a layout view;

FIG. 5: The pouring closure in a longitudinal section along the line E—E of FIG. 4;

FIG. 6: The pouring closure in a vertical section seen from the side, with the folding edge of the foldable tongue on the right side;

FIG. 7: The pouring stem of the pouring closure seen in a layout view;

FIG. 8: The pouring stem of the pouring closure in a section along the line A—A of FIG. 7;

FIG. 9: The elastic ring element of the pouring closure in the pouring position in a layout view;

FIG. 10: The elastic ring element in a section along the line A—A of FIG. 9;

FIG. 11: The elastic ring element in the extended pouring position in a vertical section seen from the side;

FIG. 12: The elastic ring element of the pouring closure in the compressed packaging position in a layout view;

FIG. 13: The elastic ring element in a section along line A—A of FIG. 12;

FIG. 14: The elastic ring element in the packaging position seen in a vertical section from the side;

FIG. 15: The elastic ring element with folded-open tongue in a layout view, i.e. seen from above;

FIG. 16: A plurality of liquid packagings fitted with the pouring closures, positioned on stacked trays.

DETAILED DESCRIPTION OF THE DRAWING FIGURES

FIG. 1 shows the pouring closure 1 inserted into the top of a liquid packaging 2. In this example, the liquid packaging 2 takes the form of an upright cylinder. Other forms for the liquid packagings are also feasible, for example a container with an elliptical cross-section, or one with a triangular cross-section, with the triangle sides possibly being curved slightly outwards, or a cubic container, etc. The side walls 3 comprise a single piece of cardboard and are welded into a tube-like structure with a vertical seam 4. Somewhat below the top edge of side wall 3 there is a horizontal top limiting surface 5, so that a rim 6 is created, along which limiting surface 5 is leakproofly connected and sealed to side wall 3.

FIG. 2 shows the opened pouring closure 1 with the liquid packaging 2 in the pouring position. It forms a funnel-shaped pouring element 7, similar to the funnel of a trumpet. In this instance, funnel 7 extends beyond the rim 6, thereby ensuring that the flow of poured liquid 8 reliably reaches beyond rim 6 in any tilted pouring position of the liquid packaging. That is the primary requirement of a good pouring geometry.

In FIG. 3, the pouring closure is shown in a vertical section from the rear, looking onto the folding edge 18 of the foldable tongue 17, which will also be shown in other drawings, and whose mode of functioning will be explained below. This pouring closure 1 is elastically deformable into two stable states so that it can be moved in the axial direction into a stable compressed position and a stable extended position. In this example it comprises three parts for this purpose, namely a pouring stem 9, a ring element 10 which can be placed leakproofly over the latter, and a cover 11, which can be screwed onto the ring element. Pouring stem 9 has a radial projection 12 on its bottom edge. Above this runs the top limiting surface 5 of the liquid packaging, shown here by a dashed line. The top side of projection 12 is sealingly welded to the limiting surface 5 after the pouring stem has been inserted into limiting surface 5 from below through a corresponding hole, which is all executed by machine in practice. As a special feature, this pouring closure has an elastically deformable ring element 10 disposed between pouring stem 9 and the threaded cap or cover 11, whose ring surface 13 runs obliquely to the ring plane, with the inner ring edge 14 ending in a downwardly directed projection 15, which can be clipped over pouring stem 9, and the outer ring edge 16 ending in an upwardly directed projection with an outer thread, not visible here because cap 11 is screwed onto it. This ring element 10 can be elastically deformed to spring into two stable forms or states, one with ring surface 13 rising from the inner ring edge 14 to the outer ring edge 16, as shown here, and one with ring surface 13 oriented downwards, as will be shown below.

FIG. 4 shows the cover 11 screwed onto this ring element 10 seen in a layout view from above. One can see the cover 11 with its tongue 17, which is inserted or positioned in a concentric recess 21 in cover 11. This tongue 17 comprises two folding arms, of which only the top one is visible here. These folding arms are folded around edge 18 and the top folding arm forms a ring 19 at its end, with two opposite thin points 20, so that the front, semi-circular part of ring 19 can be pivoted upwards in relation to the back part, i.e. tilted towards the viewer in this drawing.

FIG. 5 shows the pouring closure in a longitudinal section along line E—E of FIG. 4. Cover 11 is provided with an inner thread, by means of which it can be screwed over the outer thread 26 on the top projection 25 of ring surface 13. On the right, one can see the folding edge 18 of tongue 17 and on the left, how tongue 17 runs into ring 19 via the thin points 20. The underneath of tongue 17 is provided with a snap catch 22, so that, when in the pivoted-down position, it engages in the recess 21 in cover 11 and is held in this position. Underneath cover 11 one can recognise the important ring element 10, which, in this instance, has sprung into the upwards position in which ring surface 13 rises from inner edge 14 to outer edge 16 and hence the whole pouring closure is extended in the axial direction. When cover 11 is in the compressed position, in which ring surface 13 of ring element 10 runs obliquely downwards towards outer edge 16, tongue 17 on cover 11 serves to pull cover 11 up into the position shown here, as a result of ring element 10 springing into this position, as will be explained in more detail below. If one examines ring element 10 more closely, one can see that its ring surface 13 has thin points close to the inner 14 and outer 16 edges. Moulded onto inner edge 14, there is a downwardly directed projection 15, which has small, inwardly projecting snap catches 23 on its bottom edge. Thanks to these snap catches 23, the ring element 10 with its bottom projecting edge 15 can be clipped over pouring stem 9, whereupon it snaps into an outer peripheral groove on the stem, thereby creating a leakproof joint. At the bottom edge of pouring stem 9, one can see the radially outwardly directed projection 12, the top side of which permits the top to be welded to the inside of the top limiting surface of the liquid packaging.

FIG. 6 shows the pouring closure in a vertical section seen from the same side as in FIG. 5, namely with folding edge 18 of the foldable tongue 17 on the right. One can see the outside of cover 11 with inner thread and, resting on its surface, tongue 17 with the semi-circular ring portion 19 beyond thin points 20. Underneath cover 11, one can see the upwardly sloping ring surface 13 of ring element 10, with projection 15 adjoining at the bottom, clipped leakproofly over stem 9 with its radial projection 12.

FIG. 7 shows pouring stem 9 in a view from above. The top edge of stem 9 is tapered slightly from the outside and a groove 31 is formed around the outside of stem 9 for the purpose of receiving snap catch 23 on ring element 10. The top limiting edge of the groove is interrupted at two opposite points 24 to facilitate the clipping or clicking over of ring element 10. The view here is onto the top side of the radial projection 12, with which stem 9 is welded to the liquid packaging from the inside by means of ultrasound.

FIG. 8 shows pouring stem 9 in a section along the line A—A of FIG. 7. One can see, in particular, the special configuration of the outside of the stem with the outwardly tapered top edge 30 and the groove 31 formed below edge 30, for the purpose of receiving snapper catch 23 on ring element 10.

FIG. 9 shows the important ring element 10 of the pouring closure in a layout view. The ring surface 13 runs downwards and into the downwardly projecting edge 15, and at the top, starting from outer edge 16, into an upwardly directed projection 25, which has an outer thread formed by two opposite thread ridges 26, rising with the thread lead. In this example, these thread ridges 26 each extend along only a quarter of the circumference of projection 25.

FIG. 10 shows the elastic ring element 10 in a section along line A—A of FIG. 9. One can recognise the thin points at the inner 14 and outer 16 edges of ring surface 13 and the threaded ridge 26 on the outside of the upper projection 25. On the inside of the bottom projection 15, one can also see its special configuration. Along its top inner edge 27, it has a circular groove 29 formed by means of an inwardly and downwardly inclined peripheral projection 28, in which the top edge 30 of pouring stem 9 engages in a flush and leakproof fashion. To ensure that stem 9 is retained in this groove 29, several snap catches 23 are moulded onto the inside of the bottom projection 15. These snap into the corresponding groove 31 on the outside of stem 9 to create a leakproof joint.

FIG. 11 shows the elastic ring element 10 in its axially extended state, i.e. with the ring surface 13 rising obliquely from its inner edge 14 to its outer edge 16. In this state, ring element 10 forms a pouring funnel. On the outside of the top projection 25 one can see threaded ridge 26, which permits a cover 11 to be screwed on. The top edge of this projection 25 runs outwardly into a sharp interrupting edge 32, which permits reliable pouring without attracting the liquid.

FIG. 12 shows the elastic ring element 10 of the pouring closure in the packaging position in a layout view. In this state, it is compressed in the axial direction, so that its height is significantly reduced. In this state, ring surface 13 runs differently to that shown in FIGS. 9 to 11, which is indicated by an additional circular ring. Ring surface 13 namely now runs downwardly from the inner edge 14, seen in a radial direction, to the outer edge 16, in contrast to the state shown in FIGS. 9 to 11, where this ring surface 13 runs upwards in this direction. The ring elements 10 configuration with the two thin-point edges either side of ring surface 13 allows it to spring back and forth via a dead point between these two states, namely the one that is compressed in the axial direction, and the one that is extended in the axial direction. In both states, however, it is stable.

FIG. 13 shows the elastic ring element 10 in a section along the line A—A of FIG. 12. Here one can see how ring surface 13 slopes downward from its inner edge 14 to its outer edge 16, i.e. runs obliquely downwards. This significantly reduces the overall height of ring element 10 in relation to the state shown in FIG. 10. In the example shown, it is reduced to such a degree that projections 15;25 on the inner 14 and outer 16 edges of ring surface 13 even overlap considerably in relation to their vertical position, as the Figure clearly shows.

FIG. 14 shows the elastic ring element 10 in the packaging position, i.e. compressed in the axial direction, seen in a vertical section from the side. If one compares this state of ring element 10 with that shown in FIG. 11, one can see the difference. In one case, ring element 10 is compressed and therefore vertically reduced, in the other case it is extended, so that it forms a pouring funnel. The compressed state serves to reduce the height of the overall pouring closure 1 in such a way that it is less than, or at most equal to, rim 6 on the liquid packaging 2, i.e. 5 mm maximum, for example. At the same time, thanks to the described extendibility of this ring element 10, pouring closure 1 can form a pouring funnel whose height sufficiently extends beyond rim 6 of 5 mm to achieve a good pouring geometry, guaranteeing reliable pouring over this rim 6. In addition, the distance of pouring stem 9 from rim 6 must be at least 11 mm for technical reasons in order to leave the sealing tool enough room to seal the top surface 5 of liquid packaging 2. That is why a sufficiently high pouring stem is decisively important for a good pouring geometry. Despite the relatively large distance between pouring stem 9 and rim 6, the jet of poured liquid namely has to flow in such a way that it reliably reaches beyond rim 6. In this example, the height of the funnel formed by pouring stem 9 and ring element 10 is, thanks to the ring element 10 in the extended state, around 3 times higher than in the collapsed state. Interrupting edge 32 can be sharply configured, with a thickness of e.g. 0.3 mm maximum, to ensure that, when liquid container 2 is tilted back from the pouring position to the normal position, no liquid runs down the outside of the pouring stem as a result of surface tension and a certain capillary effect. This measure ensures that when the packaging is tilted from the normal position into the pouring position and back again, no liquid is attracted by the outside of the pouring stem.

The tongue 17, which has already been described, is intended to allow the compressed closure with the screwed-on cover 11 to be easily pulled out of its compressed position into a pouring position. FIG. 15 shows tongue 17 in its folded-open state. In the folded-down state of the tongue 17, the ring 19 on tongue 17 was engaged and pulled up using a fingernail at the point 28 which forms a fingernail indent. In doing so, the semi-circular segment of ring 19 on the other side of thin points 20 was swung upwards, so that one or two fingers can be inserted through ring 19. The tongue can then be pulled upward with greater force, whereupon it is folded-open and finally pulls cover 11 up with it. Under the effect of the pulling power, ring element 10 underneath the cover springs from the compressed state to the extended state. Once the latter state is reached, cover 11 is removed by twisting in the counterclockwise direction, leaving pouring stem 9 with the pouring funnel formed by ring element 10 open. On the bottom side of tongue 17 as shown here, one can see snap segment 22, which, when tongue 17 is folded down, engages in an associated segment 29 on the cover and holds tongue 17 in the folded-down position.

Finally, FIG. 16 shows a plurality of liquid packagings fitted with the pouring closures in a stacked arrangement. Thanks to the low construction of the pouring stem, which does not project beyond the rims of the liquid packagings, a cardboard tray can be placed directly on top of said liquid packagings. It then rests on the numerous rims of the liquid packagings. The weight of the top tray and its contents is thus distributed across all the rims of all the liquid packagings in the lower tray, similar to the way in which the weight of a fakir is distributed across many nails, thereby allowing him to lie on them without injury. The pouring closure can also, however, be extended into a pouring position as described, so that its height is then around three times as great, thereby forming a reliable pouring geometry enabling reliable pouring of the contents of the liquid packaging beyond the approximately 5 mm rim positioned at a distance of at least 11 mm.

What is claimed is:

1. A pouring closure for a liquid packaging, comprising:

a pouring stem having a radially projecting bottom edge;

a threaded cover having a diameter larger than a diameter of said pouring stem; and, an elastically deformable ring element between said pouring stem and said threaded cover for providing elastic deformability for said pouring stem, said elastically deformable ring element having a ring surface running obliquely to a ring plane of said elastically deformable ring element, with an inner ring edge ending in a downwardly directed projection capable of being clipped over said pouring stem, with an outer ring edge of said elastically deformable ring element ending in an upwardly directed projection with an outer thread for screwing on said threaded cover, said elastically deformable ring element being elastically deformable for moving said elastically deformable ring element through a dead point between a first stable state and a second stable state with said first stable state being wherein said ring surface rises upwardly from said inner ring edge to said outer ring edge and with said second stable state wherein said ring surface is downwardly sloping, said pouring closure being elastically deformable into said first stable state and said second stable state for moving into an axial direction between a stable compressed position and a stable extended position.

2. The pouring closure for a liquid packaging according to claim 1, wherein when said ring surface is obliquely oriented relative to said ring place, said inner ring edge and said outer ring edge, which project vertically to said ring plane, overlap one another, at least as partially seen in a direction of said ring plane.

3. The pouring closure for a liquid packaging according to claim 1, further comprising a tongue molded onto a top portion of said threaded cover.

4. The pouring closure for a liquid packaging according to claim 1, further comprising a folded tongue molded onto a top portion of said threaded cover; said folded tongue having a bottom folding arm molded by its bottom end to said top portion of said threaded cover along a circle-segment outer edge, said folded tongue further including a top folding arm with a ring being formed at a top end of said top folding arm, so that said ring of said top folding arm runs concentrically to said circle-segment outer edge of said bottom folding arm when said folded tongue is folded downwardly.

5. The pouring closure for a liquid packaging according to claim 4, wherein on said top portion of said threaded cover there is a concentric recess into which said folded tongue is foldable, with said ring of said top folding arm being snapable into said concentric recess.

6. The pouring closure for a liquid packaging according to claim 5, wherein said ring of said top folding arm includes an indent on its side closest to said top portion of said threaded cover for forming a hold for a user's fingernail.

7. The pouring closure for a liquid packaging according to claim 1, wherein said upwardly directed projection forms a sharp interrupting edge at said outer ring edge for permitting pouring.

8. The pouring closure for a liquid packaging according to claim 1, wherein said downwardly directed projection on said elastically deformable ring element includes snap catches engagable in a groove on an outer surface of said pouring stem.

9. The pouring closure for a liquid packaging according to claim 1, wherein said downwardly directed projection on said elastically deformable ring element there is a groove on an inner side of a top edge thereof with a top edge of said pour stem being fitable within said groove, and with said-outer thread of said upwardly directed projection on said elastically deformable ring element being formed solely be two threaded ridges, with each of said two threaded ridges extending along a quarter of a circumference of said upwardly directed projection.

* * * * *